US006142774A

United States Patent [19]

Brands et al.

[11] Patent Number: 6,142,774

[45] Date of Patent: Nov. 7, 2000

[54] SUPPORT FOR A CERAMIC WAGON SUPERSTRUCTURE FOR SUPPORTING MOLDED BLANKS OF CERAMIC MATERIAL TO BE FIRED

[75] Inventors: Detlef Brands, Meerbusch; Thomas Gerndt, Tönisvorst, both of Germany

[73] Assignee: Schunk Ingenieurkeramik GmbH, Germany

[21] Appl. No.: 09/265,753

[22] Filed: Mar. 10, 1999

[30] Foreign Application Priority Data

Mar. 11, 1998 [DE] Germany ..... 198 10 411

[51] Int. Cl.[7] ..... F27D 5/00

[52] U.S. Cl. ..... 432/261

[58] Field of Search ..... 432/253, 258, 432/259, 261; 248/149, 133, 371

[56] References Cited

U.S. PATENT DOCUMENTS

| | | | |
|---|---|---|---|
| 1,530,479 | 3/1925 | Carlson . | |
| 1,895,408 | 1/1933 | Davix . | |
| 3,412,988 | 11/1968 | Casella | 432/261 |
| 4,141,681 | 2/1979 | Lovatt | 432/258 |
| 5,752,821 | 5/1998 | Jo | 432/261 |
| 5,836,760 | 11/1998 | Turner et al. | 432/253 |

FOREIGN PATENT DOCUMENTS

| | | |
|---|---|---|
| 1419676 | 2/1966 | France . |
| 2026599 | 8/1969 | Germany . |
| 34 18 391 | 5/1984 | Germany . |
| 296 09 382 U | 8/1996 | Germany . |
| 197 18 253 | 4/1997 | Germany . |
| 298 02 626 U | 6/1998 | Germany . |

OTHER PUBLICATIONS

European Search Report dated Jun. 24, 1999.

*Primary Examiner*—Pamela Wilson
*Assistant Examiner*—Gregory A. Wilson
*Attorney, Agent, or Firm*—Patterson, Thuente, Skaar & Christensen

[57] ABSTRACT

The invention relates to a support for a wagon superstructure for holding molded blanks of ceramic material which are to be fired, comprising a planar hollow-section grid structure, which is formed from interconnected webs and is made from a silicon carbide material with a multiplicity of openings and a plurality of bearing pieces which can be fitted into appropriate openings corresponding to desired support positions for a specific molded-blank shape and can be fixed in position.

10 Claims, 2 Drawing Sheets

SUPPORT FOR A CERAMIC WAGON SUPERSTRUCTURE FOR SUPPORTING MOLDED BLANKS OF CERAMIC MATERIAL TO BE FIRED

BACKGROUND OF THE INVENTION

The invention relates to a support for a ceramic wagon superstructure for supporting molded blanks made of ceramic material which are to be fired, in particular molded tile blanks or the like.

DESCRIPTION OF RELATED ART

After drying, molded tile blanks, for the purpose of firing, are positioned on kiln wagons by means of ceramic wagon superstructures and then embark on a relatively long journey through a kiln. It is known to use ordinary ceramic material, for example cordierite, for the ceramic wagon superstructures, which are also known as firing aids, which material accommodates the molded tile blanks arranged horizontally next to one another or at a distance above one another. In this case, the mounts used for the molded blanks are so-called H-cassettes, which are essentially H-shaped when viewed from the side, the central web being adapted to the particular shape of the molded blank in order to provide appropriate support for the blank. These H-cassettes can be stacked horizontally above one another together with the molded blanks which they accommodate. Apart from the fact that these H-cassettes, despite their honeycomb structure, for reasons of stability, form a considerable mass which has to be heated in addition to the molded tile blanks, it is necessary to use different H-cassettes depending on the shape of the molded blanks.

SUMMARY OF THE INVENTION

An object of particular embodiments of the invention is to provide a support for a ceramic wagon superstructure whose mass is considerably reduced compared to the mass to be fired which is accommodated. A further object of particular embodiments of the invention is to provide a support which can easily be adapted to the shape of molded blanks which are to be fired.

The invention relates to a support for a wagon superstructure for supporting molded blanks of ceramic material which are to be fired, comprising, in a preferred embodiment, a planar hollow-section grid structure, which is formed from interconnected webs and is made from a silicon carbide material with a multiplicity of openings and a plurality of bearing pieces for inserting into appropriate openings corresponding to desired support positions for a specific molded-blank shape, said bearing pieces can be fixed in position within said openings.

Supports of this type are not only of simple design but also allow a considerable reduction in mass due to the hollow-section grid structure and the high strength of the material employed, so that the ratio of mass to be heated to mass to be fired is considerably improved. It is particularly advantageous here to use lightweight ceramic sections, i.e. sections of small wall thickness and therefore of low mass. Although the supports can also be used to arrange molded blanks which are to be fired in a stack above one another, they also permit use in an inclined position, allowing a high positioning density to be achieved. The supports are preferably suitable for essentially plate-shaped ceramic molded blanks, in particular molded tile blanks. All the parts of the ceramic wagon superstructure advantageously consist of silicon-infiltrated, reaction-bonded silicon carbide, silicon-nitride-bonded silicon carbide or recrystallized silicon carbide. Moreover, a ceramic wagon superstructure of this nature is suitable for rapid firing use. By appropriately fitting bearing pieces, it is possible to use the support for different shapes of molded blank without its mass having to be increased significantly.

Further objects, advantages and embodiments of the invention can be found in the following description and the subclaims.

The invention is explained in more detail below with reference to exemplary embodiments which are illustrated in the appended figures.

DESCRIPTION OF PREFERRED EMBODIMENTS

Figures 1, 2:
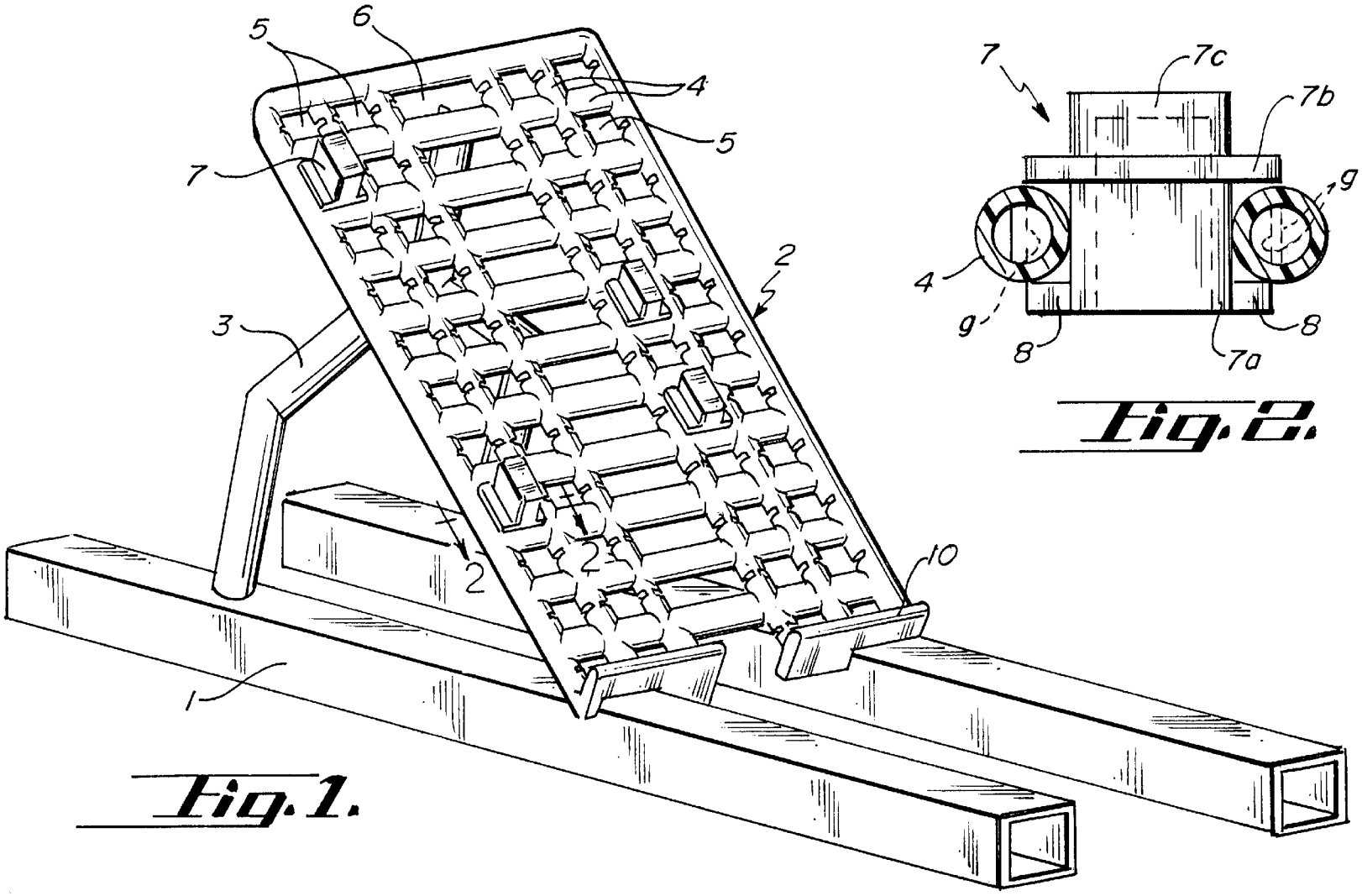
FIG. 1 shows a diagrammatic, perspective view of part of an embodiment of a ceramic wagon superstructure.
FIG. 2 shows a section on line II—II in FIG. 1.

The ceramic wagon superstructure illustrated in FIG. 1 and 2 comprises a series of elevated, parallel, horizontally arranged bars 1 which are arranged above a platform of a kiln wagon (not shown) and on top of which a multiplicity of supports 2 are arranged parallel to one another and held in a predetermined inclined position with respect to the horizontal by means of struts 3, at approximately the same distance apart. The bars 1 and the struts 3 are in the form of lightweight ceramic sections, in particular rectangular hollow sections or U-sections. Furthermore, the bars 1 are provided with insertion holes and notches, which are arranged on the topside and are spaced apart at regular intervals in the longitudinal direction of the bars, for the struts 3 and supports 2.

The support 2 comprises a planar grid structure which is formed from interconnected, in particular hollow, webs 4 and is made from a silicon carbide material, with a multiplicity of openings 5, which in the exemplary embodiment illustrated are arranged in two rows along each longitudinal edge, and further openings 6 in the central area. In the exemplary embodiment illustrated, the openings 5 and also 6 are in each case of equal size. The openings 5 and, if appropriate, 6 are used to accommodate bearing pieces 7 which can be fixed in position and can be fitted into the openings 5 and/or 6 in accordance with desired support positions for a certain shape of molded blank. The bearing pieces 7 are expediently of hollow design and comprise a foot 7*a*, which can be inserted into the opening 5 or 6, a bearing plate 7*b* for bearing against the support 2, and a bearing piece 7*c* which extends upward from the mount.

The size of the support 2 and the number and arrangement of openings 5, 6 can be optimized so as to match the shapes of molded blanks which are to be fired, in order to ensure that the mass which has to be heated in addition to the mass to be fired is minimized. In this case, the openings 5, 6 may have any suitable form and do not have to be square or rectangular as illustrated in the figure.

As can be seen from FIG. 2, mutually opposite sides of the bearing pieces 7 may, in the lower region of the foot 7*a*, each have a lateral extension 8 which can be guided through the opening 5 or 6, while the mutually opposite webs 4 which delimit the openings 5 have fit-through recesses 9 through which the lateral extensions 8 of the bearing piece 7 can be fitted into the opening 5 or 6. When inserted, the extensions 8 pass onto the underside of the support 2 and the extensions 8 are displaced with respect to the plane of the support 2 in order to fix the position, so that the extensions 8 move out of the area of the fit-through recesses 9 and pass beneath the corresponding webs 4, thus securing the bearing piece 7 in question irrespective of whether the support 2 is then used in the horizontal position or in an inclined position.

However, the bearing pieces 7 may also be designed in such a way that they are fixed in position after they have been inserted into an opening 5 or 6 by being rotated, in that their extensions 8 move out of the area of the fit-through recesses 9 by being rotated. The fit-through recesses 9 may also be formed by corresponding lengthened openings 5, such as for example the openings 6.

In order to be able to use the supports 2 stacked horizontally above one another, there is provision for inserts, which can be inserted into openings 5 and/or 6 of the grid structure, to be arranged in a corresponding manner to the bearing pieces 7 for the purpose of being able to stack supports 2 horizontally above one another, the inserts advantageously, like the bearing pieces 7, having a foot, a bearing plate and a bearing piece and being fixable in their position, for example by means of extensions.

Advantageously, supporting projections 10, which project essentially perpendicularly upward from the plane of the grid structure, for the molded blank are provided on one side, which projections, in the inclined arrangement of the support 2, serve to support the bottom of the molded blank. If the support 2 is used in the horizontal position, in particular the two supporting projections 10, together with an insert, serve as a three-point support for a further support 2.

Figure 3:
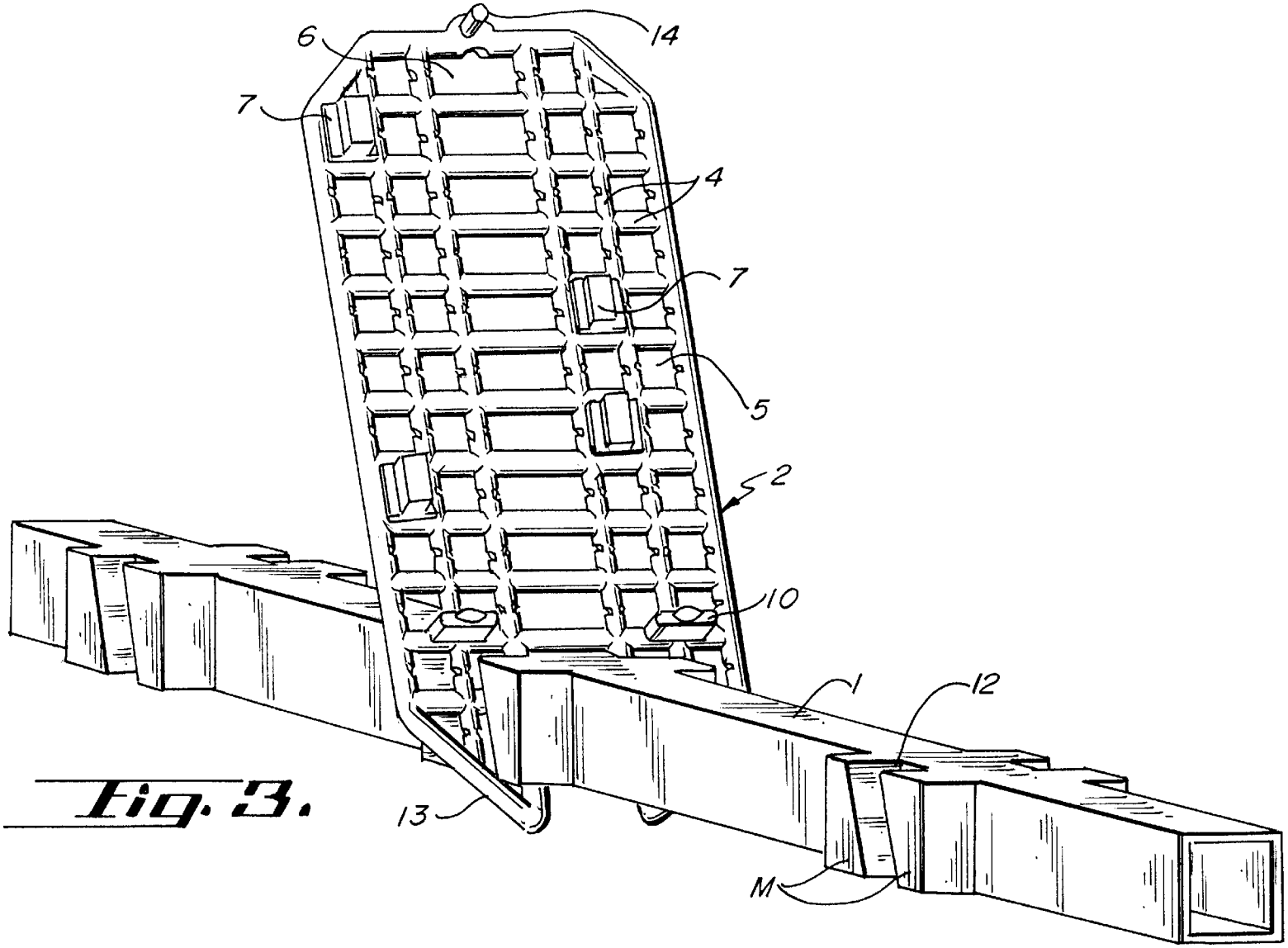
FIG. 3 shows a diagrammatic, perspective view of part of a further embodiment of a ceramic wagon superstructure.

In accordance with FIG. 3, the bars 1 may also have lateral, inclined guides 12, which are formed for example by lateral projections 11, for corresponding limbs 13 of the support 2 which engage around the bar 1, in which case it is even possible for a bar 1 on its own to accommodate a multiplicity of inclined supports 2 arranged one behind the other, so that the struts 3 and the notches on the topside of the bars 1, which are present in the embodiment shown in FIG. 1, can be dispensed with. In the embodiment illustrated in FIG. 3, a pin-like spacer 14 is provided at the top end of the support 2.

Although the foregoing has been a description of preferred embodiment of the invention, it will be apparent to those skilled in the art that numerous variations and modifications may be made to the invention without departing from the scope as described herein.

What is claimed is:

1. A support for a wagon superstructure for supporting molded blanks of ceramic material which are to be fired, comprising a planar hollow-section grid structure, which is formed from interconnected webs and is made from a silicon carbide material with a multiplicity of openings and a plurality of bearing pieces for inserting in appropriate openings corresponding to desired support positions for a specific molded-blank shape, said bearing pieces being fixed in position in said openings.

2. The support as claimed in claim 1, wherein the bearing pieces have at the bottom, on each of two opposite sides, a lateral extension which can be guided through the opening.

3. The support as claimed in claim 2, wherein mutually opposite webs which delimit the openings have fit-through recesses, through which the lateral extensions of the bearing piece can be fitted into the opening.

4. The support as claimed in claim 1, wherein inserts which can be fitted into openings in the grid structure are provided in order to allow supports to be stacked horizontally above one another.

5. The support as claimed in claim 4, wherein the inserts can be fixed in position.

6. The support as claimed in claim 1, wherein supporting projections, which project essentially perpendicularly upward from the plane of the grid structure, for the molded blank are provided on one side.

7. The support as claimed in claim 1, wherein the bearing pieces are hollow.

8. The support as claimed in claim 1, wherein the molded blanks are tile blanks.

9. A wagon superstructure of a kiln wagon for supporting molded blanks of ceramic material which are to be fired, comprising a multitude of supports having a planar hollow-section grid structure, which is formed from interconnected webs and is made from a silicon carbide material with a multiplicity of openings and a plurality of bearing pieces for inserting in appropriate openings corresponding to desired support positions for a specific molded-blank shape, said bearing pieces being fixed in position in said openings.

10. The wagon superstructure as claimed in claim 9, further comprising parallel, horizontally arranged bars for supporting the supports.

* * * * *